US010111008B2

(12) United States Patent
Guo et al.

(10) Patent No.: US 10,111,008 B2
(45) Date of Patent: Oct. 23, 2018

(54) MINIATURE SPEAKER

(71) Applicant: GOERTEK INC., WeiFang, Shandong (CN)

(72) Inventors: Xiaodong Guo, WeiFang (CN); Chao Jiang, WeiFang (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 15/507,183

(22) PCT Filed: Oct. 30, 2014

(86) PCT No.: PCT/CN2014/089887

§ 371 (c)(1),
(2) Date: Feb. 27, 2017

(87) PCT Pub. No.: WO2016/029540

PCT Pub. Date: Mar. 3, 2016

(65) Prior Publication Data

US 2017/0257705 A1 Sep. 7, 2017

(30) Foreign Application Priority Data

Aug. 26, 2014 (CN) ..... 2014 1 0425680

(51) Int. Cl.
*H04R 25/00* (2006.01)
*H04R 9/04* (2006.01)
(Continued)

(52) U.S. Cl.
CPC ..... *H04R 9/046* (2013.01); *H04R 9/06* (2013.01); *H04R 9/10* (2013.01); *H04R 25/402* (2013.01);
(Continued)

(58) Field of Classification Search
CPC . H04R 9/025; H04R 9/10; H04R 9/04; H04R 9/046; H04R 9/06; H04R 25/554;
(Continued)

(56) References Cited

U.S. PATENT DOCUMENTS 5,440,630 A * 8/1995 Yamaguchi ..... H04M 1/03 379/433.02
6,611,605 B2 * 8/2003 Kim ..... H04R 9/025 381/396

FOREIGN PATENT DOCUMENTS

CN 101552940 A 10/2009
CN 201601821 U 10/2010
(Continued)

OTHER PUBLICATIONS

International Search Report dated May 29, 2015 of PCT/CN2014/089887 which is the parent application and its English translation—4 pages.
(Continued)

*Primary Examiner* — Huyen D Le
(74) *Attorney, Agent, or Firm* — Knobbe Martens Olson & Bear LLP

(57) ABSTRACT

The present invention relates to the technical field of electroacoustic products. Disclosed is a miniature speaker. The miniature speaker comprises an upper housing and a lower housing combined together. A vibration system and a magnetic circuit system are accommodated in the space defined by the upper housing and the lower housing. The upper housing is disposed close to the vibration system. The miniature speaker also comprises a hearing-aid voice coil. The hearing-aid voice coil is fixed to the upper housing and is located at the inner side of the upper housing. The miniature speaker of the present invention solves the problem of poor acoustics caused by collision of a lead wire of a vibrating voice coil with a hearing-aid voice coil of a
(Continued)

miniature speaker in the prior art, and the miniature speaker of the present invention has good acoustic performance and a better hearing-aid effect.

7 Claims, 2 Drawing Sheets

(51) Int. Cl.

| | |
|---|---|
| ***H04R 9/06*** | (2006.01) |
| ***H04R 9/10*** | (2006.01) |
| *H04R 3/00* | (2006.01) |
| *H04R 1/00* | (2006.01) |
| *H04R 1/02* | (2006.01) |

(52) U.S. Cl.
CPC ..... *H04R 25/554* (2013.01); *H04R 25/65* (2013.01); *H04R 1/00* (2013.01); *H04R 1/025* (2013.01); *H04R 3/00* (2013.01); *H04R 2499/11* (2013.01)

(58) Field of Classification Search
CPC .. H04R 25/558; H04R 25/65; H04R 2400/07; H04R 1/025; H04R 25/402; H04R 2400/03; H04R 2499/11; H04M 1/03
USPC ..... 381/312, 322, 324, 331, 79, 189, 396, 381/401, 409, 410; 379/52, 432, 433.02, 379/438, 443
See application file for complete search history.

(56) References Cited

FOREIGN PATENT DOCUMENTS

| | | | |
|---|---|---|---|
| CN | 201616901 | U | 10/2010 |
| CN | 201639760 | U | 11/2010 |
| CN | 101969595 | A | 2/2011 |
| CN | 102883251 | A | 1/2013 |
| CN | 202841506 | U | 3/2013 |
| CN | 204046807 | U | 12/2014 |

OTHER PUBLICATIONS

Office Action dated Jan. 4, 2017 of corresponding Chinese Patent Application No. 2016122901799380—14 pages.

* cited by examiner

MINIATURE SPEAKER

TECHNICAL FIELD

The present invention relates to the technical field of electro-acoustic products, specifically, to a miniature speaker with a hearing-aid voice coil.

BACKGROUND ART

The miniature speaker is an important acoustical component for portable electronic devices, and is used for transforming between electric signal and acoustical signal, and the miniature speaker is an energy converter. Typical miniature speaker usually comprises a housing in which a vibration system and a magnetic circuit system are accommodated. The vibration system comprises a vibrating diaphragm and a vibrating voice coil, wherein the vibrating voice coil is subjected to the acting force of the electromagnetic field and moves up and down according to the polarities of the audio electric signal, thereby enabling the vibrating diaphragm to generate sounds and thus achieving energy transformation between electricity and sound.

Nowadays, more and more old people use hearing aids, however, their hearing aids will squeak and thus become unusable when they are answering calls with telephones equipped with common speakers. Therefore, a hearing-aid voice coil is added into the common speaker by those skilled in the art. Then, audio electric signal is transformed into electromagnetic field through the hearing-aid voice coil, the hearing aid may be switched to such a mode, in which mode the signal is collected by an induction coil in the hearing aid, and the induced signal is amplified and restored into sounds. FIG. 5 illustrates the main structure of a speaker equipped with a hearing-aid voice coil in prior art, which comprises an upper housing 10*b* and a lower housing 20*b* combined together, a vibration system and a magnetic circuit system are accommodated in the space defined by the upper housing 10*b* and the lower housing 20*b*, and a hearing-aid voice coil 70*b* is fixed on the lower housing 20*b* and surrounds the periphery of the magnetic circuit system. However, the miniature speaker with such a structure has a very small space beneath the vibrating diaphragm. Thus, a lead wire of the vibrating voice coil is very easy to contact with the hearing-aid voice coil when the vibrating voice coil vibrates up and down, which makes the higher harmonic of the speaker distort and breaks the lead wire of the vibrating voice coil as well, resulting in defects of the speaker, such as making noise.

SUMMARY

The technical problem sought to be solved by the present invention is to provide a miniature speaker which has good acoustic performance and better hearing-aid effect without higher harmonic distortion.

In order to solve the above technical problem, the technical solution of the present invention is as follows:

a miniature speaker, comprising an upper housing and a lower housing which are combined together, wherein a vibration system and a magnetic circuit system are accommodated in a space defined by the upper housing and the lower housing, and the upper housing is arranged close to the vibration system, wherein the miniature speaker further comprises a hearing-aid voice coil fixed on the upper housing and located at the inner side of the upper housing.

In particular, the upper housing has a stepped structure with a side having a larger thickness and the other side having a smaller thickness, and the hearing-aid voice coil is fixed at the side having a larger thickness.

In particular, an annular groove is provided at the side having a larger thickness, the hearing-aid voice coil is fixed in the annular groove, and a surface of the hearing-aid voice coil exposed to the inner side of the upper housing is flush with an inner surface of the upper housing.

In particular, extension recesses extending towards the outside of the annular groove are provided at both ends of one side of the annular groove, respectively, and the one side is located at a middle part of the upper housing; wherein two first pads for soldering lead wires of the hearing-aid voice coil are arranged at bottoms of two said extension recesses, respectively, two second pads electrically connected with the two first pads respectively are arranged on an end surface of the upper housing in contact with the lower housing, and the second pads are electrically connected with an external circuit of the speaker.

In particular, pads for the hearing-aid voice coil are arranged on portions of an end surface of the lower housing opposite to the two second pads, respectively, the two second pads are electrically connected with the pads for the hearing-aid voice coil, respectively, and the pads for the hearing-aid voice coil are electrically connected with the external circuit of the speaker.

In particular, the lower housing has an annular structure which is open at both ends, one end of the lower housing away from the upper housing has a stepped structure, and the pads for the hearing-aid voice coil are located on a lower end surface of the lower housing.

In particular, the magnetic circuit system comprises a yoke fixed on the lower housing, and a magnet and a washer which are sequentially arranged in the yoke; and an external surface of a bottom of the yoke is flush with a higher end surface of the lower housing.

In particular, the lower end surface and the higher end surface are connected integrally through a connecting sidewall in which an opening is arranged at a position opposite to the yoke, a sidewall of the yoke is located at the opening, and an external surface of the sidewall of the yoke is flush with an external surface of the connecting sidewall.

In particular, the vibration system comprises a vibrating diaphragm with an edge portion thereof fixed between the upper housing and the lower housing, and a backing ring is arranged between the edge portion of the vibrating diaphragm and the upper housing.

With the above technical solutions, the present invention achieves the following technical effects:

The miniature speaker provided by the present invention comprises an upper housing and a lower housing combined together, a vibration system and a magnetic circuit system are accommodated in the space defined by the upper housing and the lower housing. The miniature speaker further comprises a hearing-aid voice coil fixed inside the upper housing, and the upper housing is arranged close to the vibration system. With the hearing-aid voice coil being arranged on the upper housing, the space in the thickness direction of the upper housing is fully used, the size of the magnetic circuit system is increased, and the space beneath the vibrating diaphragm is enlarged as well. Therefore, the lead wire of the vibrating voice coil is prevented from colliding with the hearing-aid voice coil when the vibrating voice coil vibrates, thus the defects such as higher harmonic distortion, breakage of the lead wire of the vibrating voice coil, noise and the like caused by collision of the lead wire of the vibrating voice coil with the hearing-aid voice coil are avoided, the acoustic performance of the miniature speaker is improved, and the service life of the miniature speaker is prolonged. Besides, since the hearing-aid voice coil is arranged on the upper housing, which is closer to the end customers, the hearing aids worn by the users can detect stronger magnetic field generated by the hearing-aid voice coil and thus may have better effect of hearing aid.

In conclusion, the miniature speaker provided by the present invention solves acoustic defects of the miniature speaker in the prior art caused by collision of the lead wire of the vibrating voice coil and the hearing-aid voice coil, and thus the miniature speaker provided by the present invention has good acoustic performance and better hearing-aid effect.

In the figures: 10*a*: upper housing; 10*b*: upper housing; 12: sound hole; 14: positioning boss; 20*a*: lower housing; 20*b*: lower housing; 30: dome; 32: vibrating diaphragm; 34: vibrating voice coil; 40: yoke; 42: magnet; 44: washer; 50: backing ring; 60: first pad; 62: second pad; 64: pad for the vibrating voice coil; 66: pad for the hearing-aid voice coil; 70*a*: hearing-aid voice coil; 70*b*: hearing-aid voice coil; 72: lead wire of the hearing-aid voice coil.

DETAILED DESCRIPTION OF EMBODIMENTS

The present invention is described below in details in connection with the accompanying figures and embodiments.

Figure 1:
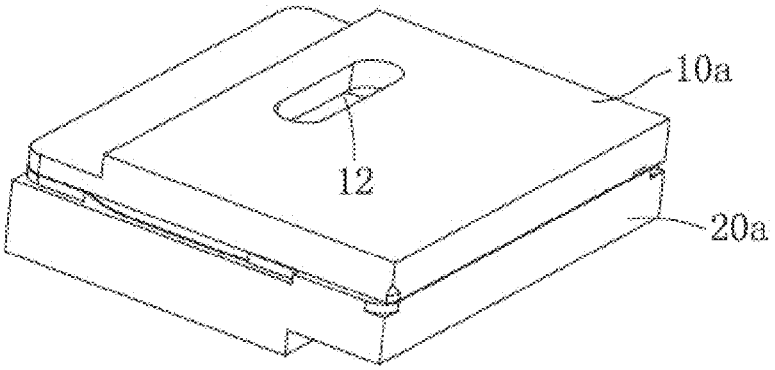
FIG. 1 is a schematic view illustrating the three dimensional structure of the miniature speaker of the present invention.

As illustrated in FIG. 1, a miniature speaker comprises an upper housing 10*a* and a lower housing 20*a* combined together, a vibration system and a magnetic circuit system are accommodated in the space defined by the upper housing 10*a* and the lower housing 20*a*, the upper housing 10*a* is arranged close to the vibration system, wherein a sound hole 12 is arranged in the upper housing 10*a* at a position opposite to the vibration system, and the lower housing 20*a* is arranged close to the magnetic circuit system.

Figure 3:
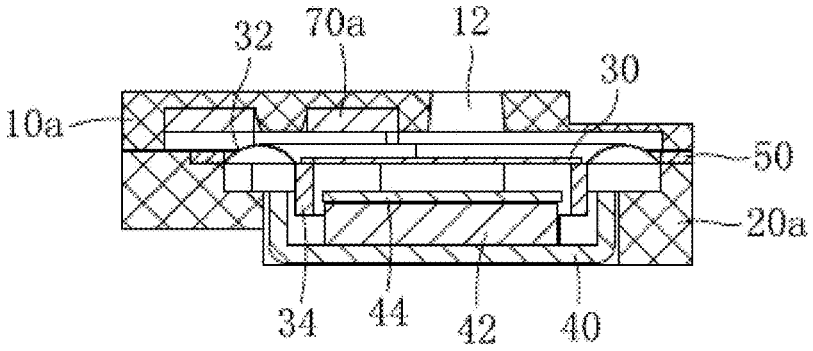
FIG. 3 is a schematic view illustrating the sectional structure of the miniature speaker of the present invention.

As illustrated in FIG. 3, the vibration system comprises a vibrating diaphragm 32, wherein an edge portion of the vibrating diaphragm 32 is fixed between the upper housing 10*a* and the lower housing 20*a*, a dome 30 is fixed at a central position of one side of the vibrating diaphragm 32 closer to the upper housing 10*a*, and a vibrating voice coil 34 is fixed at the other side (that is, the side closer to the magnetic circuit system) of the vibrating diaphragm 32, and the winding tap of the vibrating voice coil 34 is the lead wire thereof. The magnetic circuit system comprises a yoke 40 fixed on the lower housing 20*a*. The yoke 40 comprises a rectangular bottom and four sidewalls which are arranged at the edges of four sides of the bottom and are perpendicular to the bottom, a magnet 42 and an washer 44 are successively fixed at the inner side of the bottom of the yoke 40, a magnetic gap is arranged between the magnet 42 along with the washer 44 and the sidewalls of the yoke 40, and the end portion of the vibrating voice coil 34 is located in the magnetic gap. The vibrating voice coil 34 moves in such a way that the vibrating voice coil 34 cuts magnetic flux lines in the magnetic gap repeatedly according to the magnitudes and polarities of the audio electric signals transmitting through the windings of the vibrating voice coil 34, and then the vibrating diaphragm 32 vibrates according to reciprocating motion of the vibrating voice coil 34, so as to stir up the air to generate sound, thereby achieving the energy conversion from electricity to sound.

Figure 4:
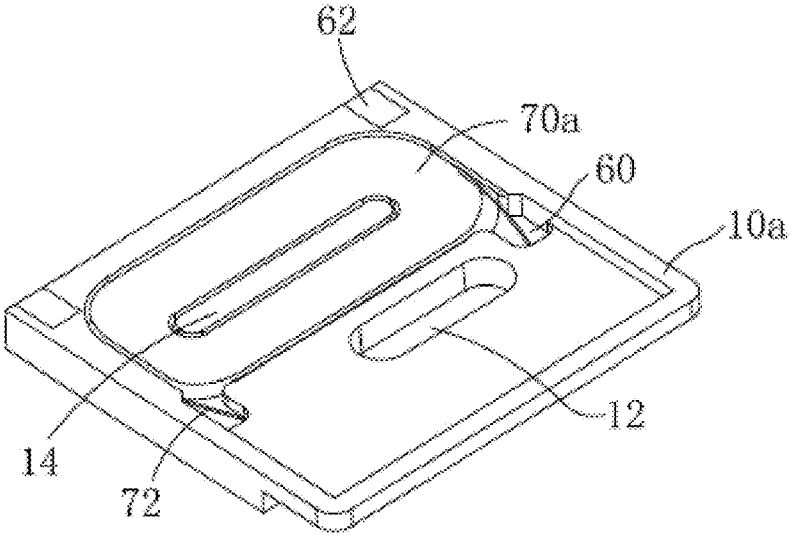
FIG. 4 is a schematic view illustrating the combined structure of the upper housing and the hearing-aid voice coil of the miniature speaker of the present invention.
Figure 5:
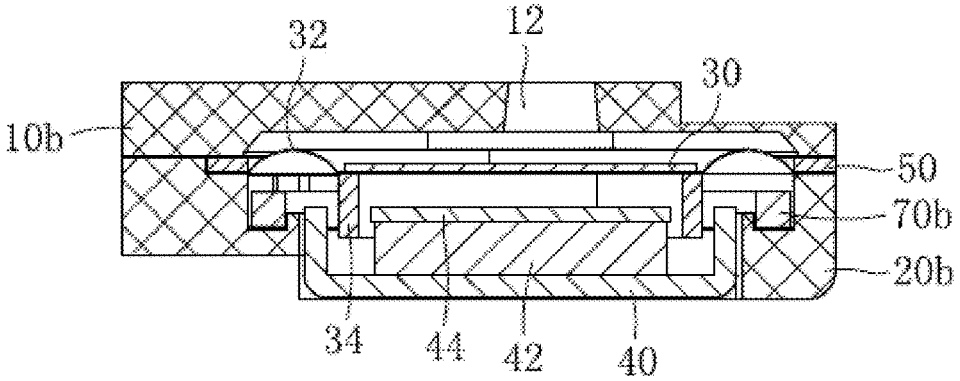
(PRIOR ART) Fig. 5
FIG. 5 is a schematic view illustrating the sectional structure of the miniature speaker in the prior art.

As shown in FIG. 3 and FIG. 4, the miniature speaker further comprises a hearing-aid voice coil 70*a* fixed inside the upper housing 10*a*. The upper housing 10*a* has a stepped structure with a thicker portion and a thinner portion, wherein an annular groove is provided at the inner side of the thicker portion of the upper housing 10*a*, and the annular groove keeps away from the sound hole 12 and is provided at one side of the sound hole 12. The hearing-aid voice coil 70*a* is fixed in the annular groove, wherein a positioning boss 14 matching with an inner ring of the hearing-aid voice coil 70*a* is formed at the center of the annular groove, and the hearing-aid voice coil 70*a* is accurately fixed on the upper housing 10*a* by means of the positioning boss 14.

Figure 2:
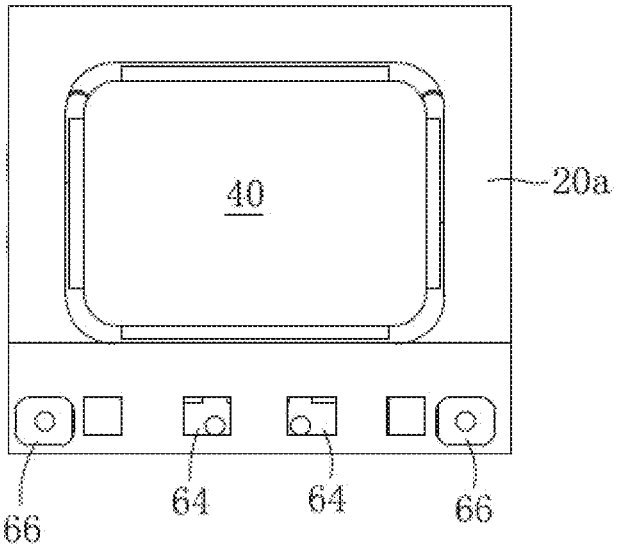
FIG. 2 is a schematic view illustrating the plane structure of the miniature speaker of the present invention.

As shown in FIG. 2 and FIG. 4, two pads 64 for the vibrating voice coil, which are used for electrically connecting the vibrating voice coil 34 (as shown in FIG. 3) and the external circuit outside the speaker, are arranged on an end surface of the lower housing 20*a* which end surface is not contacted with the upper housing 10*a*; and two pads 66 for the hearing-aid voice coil, which are used for electrically connecting the hearing-aid voice coil 70*a* and the external circuit outside the speaker, are further provided on the above end surface, wherein the two pads 66 for the hearing-aid voice coil are arranged at outer sides of the two pads 64 for the vibrating voice coil, respectively. Two extension recesses extending towards outside of the annular groove are arranged at both ends of one side of the annular groove located at the middle part of the upper housing 10*a*, and two first pads 60 for soldering lead wires 72 of the hearing-aid voice coil are arranged at the bottoms of the two extension recesses, respectively. Two second pads 62 are arranged on an end surface of the upper housing 10*a* combined with the lower housing 20*a*, and the two second pads 62 are located at both ends of one side of the upper housing 10*a*, and the two second pads 62 correspond to and are electrically connected with the two first pads 60 respectively. Each of the two second pads 62 is electrically connected with one of the two pads 66 for the hearing-aid voice coil through an electric connecting part (not illustrated).

As shown in FIG. 3 and FIG. 4, one side of the edge portion of the vibrating diaphragm 32 is fixed on an end surface of the lower housing 20*a*, wherein the end surface of the lower housing 20*a* to which the vibrating diaphragm 32 is fixed is lower than other end surfaces at other positions, and a backing ring 50 is fixed between the other side of the edge portion of the vibrating diaphragm 32 and the upper housing 10*a*. The backing ring 50 can be used for enhancing the strength of the vibrating diaphragm 32. A surface of the backing ring 50 is flush with an end surface of the lower housing 20*a* to which the vibrating diaphragm 32 is not fixed, and a portion of the backing ring 50, which portion is located at an edge position of the lower housing 20*a*, is combined with the upper housing 10*a*. A lateral side of the upper housing 10*a* provided with the second pads 62 is combined with the end surface of the lower housing 20*a* to which the vibrating diaphragm 32 is not fixed.

As shown in FIG. 2 and FIG. 3, the lower housing 20*a* has an annular structure with both sides open, and one end of the lower housing 20*a* away from the upper housing 10*a* has a stepped structure. The stepped structure comprises a lower end surface and a higher end surface, wherein the two end surfaces are parallel with each other and connected integrally via a connecting sidewall. The distance between the lower end surface and the upper housing 10*a* is less than the distance between the higher end surface and the upper housing 10*a*. The pads 64 for the vibrating voice coil and the pads 66 for the hearing-aid voice coil are located on the lower end surface. The yoke 40 is exposed to the outside of the lower housing 20*a* through an opening of the lower housing 20*a*, and the external surface of the bottom of the yoke 40 is flush with the higher end surface of the lower housing 20*a*. An opening is arranged in the connecting sidewall at a position opposite to one sidewall of the yoke 40, the sidewall of the yoke 40 is exposed to the outside of the lower housing 20*a* through the opening, and the external surface of the sidewall of the yoke is flush with the external surface of the connecting sidewall. Such structure of the lower housing 20*a* not only enlarges the internal cavity of the miniature speaker, which then enables larger sizes of components of the magnetic circuit system and improves the acoustic performance of the speaker, but also decreases the thickness of the speaker, which enables the miniature speaker to satisfy the thinness requirement of portable electronic equipment.

In the present invention, conventional design concept adopted by those skilled in the art is changed in such a way that the hearing-aid voice coil is fixed on the upper housing, thereby effectively utilizing the space in the thickness direction of the upper housing, increasing the size of the magnetic circuit system, enlarging the space below the vibrating diaphragm as well, avoiding various defects due to the collision of the lead wire of the vibrating voice coil with the hearing-aid voice coil of conventional products, substantially improving the acoustic performance of the miniature speaker having the hearing-aid voice coil, prolonging the service life of the miniature speaker, and substantially improving the hearing-aid effect of the miniature speaker.

In the present invention, the miniature speaker shown in FIG. 1 to FIG. 4 is only an example for visually and particularly illustrating the technical solution of the present invention that the hearing-aid voice coil is arranged on the housing closer to the vibration system. In practical use, the technical solution can be used for a miniature speaker with such structure, and another kind of miniature speaker provided with a hearing-aid voice coil and having appropriate internal and external structures can also employ the technical solution of the present invention and achieve the same technical effect as that of the present invention, regardless whether its structure is the same as that of the present invention or not. Thus, products with the hearing-aid voice coil provided on a housing closer to the vibration system will fall into the scope of protection of the present invention.

The numbered terms of "first pad" and "second pad" in this specification are only used for distinguishing between different technical features, and do not relate to their location relationship, installation sequence, operation sequence, and so on.

The present invention is not limited to the above specific embodiments, and various variations made by those skilled in the art according to the above conceptions without creative labor will fall into the scope of protection of the present invention.

The invention claimed is:

1. A miniature speaker, comprising an upper housing and a lower housing which are combined together, wherein a vibration system and a magnetic circuit system are accommodated in a space defined by the upper housing and the lower housing, the magnetic circuit system is provided at the lower housing and is located at one side of the vibration system and the upper housing is located at another side of the vibration system away from the magnetic circuit system, wherein the miniature speaker further comprises a hearing-aid voice coil fixed on the upper housing and located at an inner side of the upper housing, wherein the upper housing has a stepped structure with a first side and a second side, the first side being thicker than the second side, wherein the hearing-aid voice coil is fixed at the first side of the upper housing, wherein an annular groove is provided at the first side, wherein a positioning boss matching with an inner ring of the hearing-aid voice coil is formed at a center of the annular groove, wherein the hearing-aid voice coil is fixed in the annular groove, and wherein a surface of the hearing-aid voice coil exposed to the inner side of the upper housing is flush with an inner surface of the upper housing.

2. The miniature speaker according to claim 1, wherein extension recesses extending towards the outside of the annular groove are provided at both ends of one side of the annular groove respectively, and the one side is located at a middle part of the upper housing; two first pads for soldering lead wires of the hearing-aid voice coil are arranged at bottoms of two said extension recesses, respectively, two second pads electrically connected with the two first pads respectively are arranged on an end surface of the upper housing in contact with the lower housing, and the second pads are electrically connected with an external circuit of the speaker.

3. The miniature speaker according to claim 2, wherein pads for the hearing-aid voice coil are arranged on portions of an end surface of the lower housing opposite to the two second pads, respectively, the two second pads are electrically connected with the pads for the hearing-aid voice coil, respectively, and the pads for the hearing-aid voice coil are electrically connected with the external circuit of the speaker.

4. The miniature speaker according to claim 3, wherein the lower housing has an annular structure which is open at both ends, one end of the lower housing away from the upper housing has a stepped structure, and the pads for the hearing-aid voice coil are located on a lower end surface of the lower housing.

5. The miniature speaker according to claim 4, wherein the magnetic circuit system comprises a yoke fixed on the lower housing, and a magnet and a washer which are sequentially arranged in the yoke; and an external surface of a bottom of the yoke is flush with a higher end surface of the lower housing.

6. The miniature speaker according to claim 5, wherein the lower end surface and the higher end surface are connected integrally through a connecting sidewall in which an opening is arranged at a position opposite to the yoke, a sidewall of the yoke is located at the opening, and an external surface of the sidewall of the yoke is flush with an external surface of the connecting sidewall.

7. The miniature speaker according to claim 1, wherein the vibration system comprises a vibrating diaphragm with an edge portion thereof fixed between the upper housing and the lower housing, and a backing ring is arranged between the edge portion of the vibrating diaphragm and the upper housing.

* * * * *